US008602100B2

(12) United States Patent
Dykstra et al.

(10) Patent No.: US 8,602,100 B2
(45) Date of Patent: Dec. 10, 2013

(54) MANAGING TREATMENT OF SUBTERRANEAN ZONES

(75) Inventors: Jason D. Dykstra, Carrollton, TX (US); Michael Linley Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 316 days.

(21) Appl. No.: 13/161,605

(22) Filed: Jun. 16, 2011

(65) Prior Publication Data

US 2012/0323378 A1 Dec. 20, 2012

(51) Int. Cl.
*E21B 43/24* (2006.01)
*G06G 7/57* (2006.01)

(52) U.S. Cl.
USPC ..... 166/272.3; 166/302; 703/10

(58) Field of Classification Search
USPC ..... 166/272.3, 302; 703/9–10
See application file for complete search history.

(56) References Cited

U.S. PATENT DOCUMENTS

| | | | |
|---|---|---|---|
| 3,982,591 | A | 9/1976 | Hamrick et al. |
| 4,077,469 | A | 3/1978 | Hamrick et al. |
| 4,385,661 | A | 5/1983 | Fox |
| 4,423,780 | A | 1/1984 | Vigneri et al. |
| 4,930,454 | A | 6/1990 | Latty et al. |
| 4,986,352 | A | 1/1991 | Alameddine |
| 6,016,867 | A | 1/2000 | Gregoli et al. |
| 6,848,503 | B2 | 2/2005 | Schultz et al. |
| 7,165,608 | B2 | 1/2007 | Schultz et al. |
| 7,246,660 | B2 | 7/2007 | Fripp et al. |
| 7,270,141 | B2 | 9/2007 | Dykstra |
| 7,308,379 | B2 | 12/2007 | Dykstra et al. |
| 7,353,874 | B2 | 4/2008 | Dykstra et al. |
| 7,356,427 | B2 | 4/2008 | Dykstra et al. |
| 7,392,113 | B2 | 6/2008 | Dykstra |
| 7,415,364 | B2 | 8/2008 | Mazrooee et al. |
| 7,428,922 | B2 | 9/2008 | Fripp et al. |
| 7,433,762 | B2 | 10/2008 | Dykstra |

(Continued)

FOREIGN PATENT DOCUMENTS

| | | | |
|---|---|---|---|
| EP | 0072675 | B1 | 10/1986 |
| WO | WO 2009 009336 | A2 | 1/2009 |

OTHER PUBLICATIONS

A.J. Mulac, et al., "Project Deep Stream Preliminary Field Test" Sandia National Laboratories, Apr. 1981 (34 pages).

(Continued)

*Primary Examiner* — Giovanna Wright
(74) *Attorney, Agent, or Firm* — Scott Wendorf; Fish & Richardson P.C.

(57) ABSTRACT

A downhole heated fluid generation system includes: a plurality of subsystems, including an air subsystem having an air compressor or an air flow control valve, a fuel subsystem having a fuel compressor or a fuel flow control valve, a treatment fluid subsystem having a fluid pump; a combustor coupled to at least one of the plurality of subsystems to provide a heated fluid into at least one of a wellbore or a subterranean zone; and a controller operable to: receiving an input indicative of a desired flow rate of the heated fluid; receiving an input indicative of a desired quality of the heated fluid; determining a virtual flow rate of the heated fluid based, at least in part, on the input indicative of the desired flow rate; and controlling the plurality of subsystems with the virtual flow rate of the heated fluid.

22 Claims, 4 Drawing Sheets

(56) References Cited

U.S. PATENT DOCUMENTS

| | | | | |
|---|---|---|---|---|
| 7,494,263 | B2 | 2/2009 | Dykstra et al. | |
| 7,516,793 | B2 | 4/2009 | Dykstra | |
| 7,543,645 | B2 | 6/2009 | Dykstra et al. | |
| 7,561,943 | B2 | 7/2009 | Dykstra et al. | |
| 7,567,856 | B2 | 7/2009 | Dykstra et al. | |
| 7,574,325 | B2 | 8/2009 | Dykstra | |
| 7,606,636 | B2 | 10/2009 | Dykstra | |
| 7,620,481 | B2 | 11/2009 | Dykstra | |
| 7,636,614 | B2 | 12/2009 | Dykstra | |
| 7,660,648 | B2 | 2/2010 | Dykstra | |
| 7,680,617 | B2 | 3/2010 | Mazrooee et al. | |
| 7,686,499 | B2 | 3/2010 | Dykstra et al. | |
| 7,809,538 | B2 | 10/2010 | Thomas | |
| 7,836,949 | B2 | 11/2010 | Dykstra | |
| 7,891,423 | B2 | 2/2011 | Dykstra | |
| 2003/0131986 | A1 | 7/2003 | Schultz et al. | |
| 2003/0166470 | A1 | 9/2003 | Fripp et al. | |
| 2005/0039921 | A1 | 2/2005 | Schultz et al. | |
| 2005/0051323 | A1 | 3/2005 | Fripp et al. | |
| 2006/0112701 | A1 | 6/2006 | Dykstra | |
| 2006/0118170 | A1 | 6/2006 | Dykstra | |
| 2006/0161358 | A1 | 7/2006 | Dykstra et al. | |
| 2006/0176640 | A1 | 8/2006 | Dykstra | |
| 2006/0177203 | A1 | 8/2006 | Dykstra | |
| 2006/0231259 | A1 | 10/2006 | Dykstra et al. | |
| 2006/0233039 | A1 | 10/2006 | Dykstra et al. | |
| 2006/0235627 | A1 | 10/2006 | Dykstra et al. | |
| 2007/0003831 | A1 | 1/2007 | Fripp et al. | |
| 2007/0153622 | A1 | 7/2007 | Dykstra et al. | |
| 2007/0153623 | A1 | 7/2007 | Dykstra et al. | |
| 2007/0153624 | A1 | 7/2007 | Dykstra et al. | |
| 2007/0168170 | A1* | 7/2007 | Thomas | 703/10 |
| 2007/0171765 | A1 | 7/2007 | Dykstra et al. | |
| 2007/0295924 | A1 | 12/2007 | Clausen | |
| 2008/0030365 | A1 | 2/2008 | Fripp et al. | |
| 2008/0084783 | A1 | 4/2008 | Mazrooee et al. | |
| 2008/0114554 | A1 | 5/2008 | Mazrooee et al. | |
| 2008/0164021 | A1 | 7/2008 | Dykstra | |
| 2008/0164023 | A1 | 7/2008 | Dykstra et al. | |
| 2008/0165612 | A1 | 7/2008 | Dykstra | |
| 2008/0165613 | A1 | 7/2008 | Dykstra | |
| 2008/0179056 | A1 | 7/2008 | Dykstra | |
| 2008/0183310 | A1 | 7/2008 | Dykstra | |
| 2008/0183336 | A1 | 7/2008 | Dykstra | |
| 2008/0183415 | A1 | 7/2008 | Dykstra | |
| 2008/0236818 | A1 | 10/2008 | Dykstra | |
| 2009/0008096 | A1 | 1/2009 | Schultz et al. | |
| 2009/0055141 | A1 | 2/2009 | Moncorge et al. | |
| 2009/0118866 | A1 | 5/2009 | Dykstra et al. | |
| 2010/0263861 | A1 | 10/2010 | Dykstra | |
| 2011/0042091 | A1 | 2/2011 | Dykstra et al. | |
| 2011/0042092 | A1 | 2/2011 | Fripp et al. | |
| 2011/0122727 | A1 | 5/2011 | Gleitman et al. | |
| 2011/0168390 | A1 | 7/2011 | Fripp et al. | |
| 2011/0186300 | A1 | 8/2011 | Dykstra et al. | |
| 2011/0214876 | A1 | 9/2011 | Dykstra et al. | |
| 2011/0240284 | A1 | 10/2011 | Hamid et al. | |
| 2011/0265987 | A1 | 11/2011 | Wright et al. | |
| 2011/0266001 | A1 | 11/2011 | Dykstra et al. | |
| 2011/0297384 | A1 | 12/2011 | Fripp et al. | |
| 2011/0297385 | A1 | 12/2011 | Dykstra et al. | |
| 2011/0308806 | A9 | 12/2011 | Dykstra et al. | |
| 2012/0018167 | A1 | 1/2012 | Konopczynski et al. | |
| 2012/0059640 | A1* | 3/2012 | Roy et al. | 703/10 |
| 2012/0060624 | A1 | 3/2012 | Dykstra | |
| 2012/0061088 | A1 | 3/2012 | Dykstra et al. | |

OTHER PUBLICATIONS

Notification of Transmittal of the International Search Report and the Written Opinion of the International Searching Authority, or Declaration (2 pages); International Search Report (3 pages); and Written Opinion of the International Searching Authority (4 pages), mailed Jan. 10, 2013, for related international application PCT/US2012/042256.

Notification of Transmittal of the International Search Report and the Written Opinion of the International Searching Authority, or Declaration (2 pages); International Search Report (3 pages); and Written Opinion of the International Searching Authority (4 pages), mailed Jan. 10, 2013, for related international application PCT/US2012/041890.

* cited by examiner

MANAGING TREATMENT OF SUBTERRANEAN ZONES

TECHNICAL BACKGROUND

This disclosure relates to managing, directing, and otherwise controlling a treatment of one or more subterranean zones using heated fluid.

BACKGROUND

Heated fluid, such as steam, can be injected into a subterranean formation to facilitate production of fluids from the formation. For example, steam may be used to reduce the viscosity of fluid resources in the formation, so that the resources can more freely flow into the well bore and to the surface. Generally, steam generated for injection into a well requires large amounts of energy such as to compress and/or transport air, fuel, and water used to produce the steam. Much of this energy is largely lost to the environment without being harnessed in any useful way. Consequently, production of steam has large costs associated with its production.

Furthermore, a control system for managing, directing, or otherwise controlling a downhole steam generation system often must control a number of components, such as, for example, compressors, pumps, valves, downhole combustors, and/or steam generators. The control system, ideally, should efficiently provide quantities of fuel, air, and water injection for downhole steam generation through the control of such components. An efficient and coordinated control system for the components of the downhole steam generation system may reduce failures that could occur, for example, by using separate controllers or a manual control system for the downhole steam generation system.

DETAILED DESCRIPTION

Figure 1:
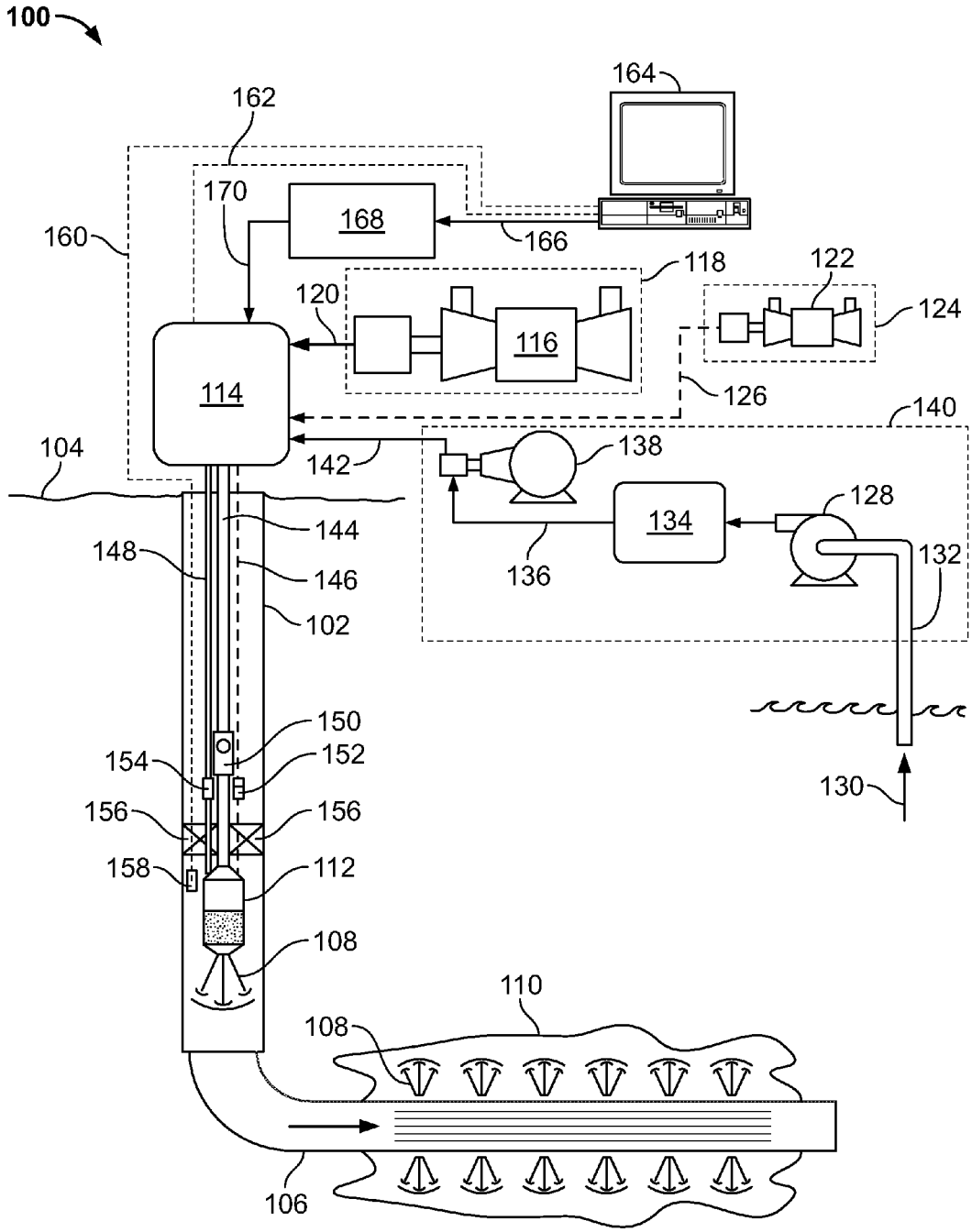
FIG. 1 illustrates an example embodiment of a heated fluid generation system.

The present disclosure relates to controlling a system for treating a subterranean zone using heated fluid introduced into the subterranean zone via a well bore. The fluid is heated, in some instances, to form steam. The subterranean zone can include all or a portion of a resource bearing subterranean formation, multiple resource bearing subterranean formations, or all or part of one or more other intervals that it is desired to treat with the heated fluid. The fluid is heated, at least in part, using heat recovered from near-by operation. The heated fluid can be used to reduce the viscosity of resources in the subterranean zone to enhance recovery of those resources. In some embodiments, the system for treating a subterranean zone using heated fluid may be suitable for use in a "huff and puff" process, where heated fluid is injected through the same bore in which resources are recovered. For example, the heated fluid may be injected for a specified period, then resources withdrawn for a specified period. The cycles of injecting heated fluid and recovering resources can be repeated numerous times. Additionally, the systems and techniques of the present disclosure may be used in a Steam Assisted Gravity Drainage ("SAGD").

In some embodiments, the control system may create a virtual heated fluid generation rate and couple one or more of the heated fluid generation subsystems to this virtual rate. The heated fluid generation subsystems may include, for example, one or more valve subsystems, one or more compressor subsystems, one or more pump subsystems, and/or one or more compressor-valve subsystems. For instance, there may compressor-valve subsystems for both an air system (or subsystem) as well as a fuel (e.g., methane) system (or subsystem). Each subsystem may function to reduce the virtual rate through feedback and feed forward control if the virtual rate exceeds the capability of the particular subsystem to meet the desired setpoint (e.g., desired flow rate, speed, position, or otherwise). In some embodiments, a system operator may need to provide only two input values: desired heated fluid flow rate (e.g., steam flow rate) and desired heated fluid quality (e.g., steam quality). All other inputs to the components (e.g., valves, compressors, pumps, and others) may be handled by the control system. Each of the components and subsystems may be balanced according to the virtual heated fluid generation rate in order to ensure that the entire heated fluid generation system does not become unstable, for example, with one or more components unable to meet the desired setpoints. Thus, ramping the virtual heated fluid generation rate up and/or down may cause all of the components and/or subsystems to correspondingly ramp up and/or down.

In one general embodiment, a method for controlling a downhole heated fluid generation system includes receiving an input indicative of a desired flow rate of a heated fluid, the heated fluid generated by the downhole heated fluid generation system to inject into at least one of a wellbore or a subterranean zone; receiving an input indicative of a desired quality of the heated fluid; determining a virtual flow rate of the heated fluid based, at least in part, on the input indicative of the desired flow rate; and controlling a plurality of subsystems of the downhole heated fluid generation system with the virtual flow rate of the heated fluid.

In one aspect of the general embodiment, determining a virtual flow rate of the heated fluid based, at least in part, on the input indicative of the desired flow rate may include determining the virtual flow rate of the heated fluid independent of the input indicative of the desired quality of the heated fluid.

In one aspect of the general embodiment, controlling a plurality of subsystems of the downhole heated fluid generation system with the virtual flow rate of the heated fluid may include: determining an expected airflow rate through an air subsystem of the downhole heated fluid generation system based, at least in part, on the virtual flow rate of the heated fluid; determining an actual airflow rate through the air subsystem; and adjusting the virtual flow rate of the heated fluid based, at least in part, on the actual airflow rate and the expected airflow rate.

In one aspect of the general embodiment, adjusting the virtual flow rate of the heated fluid based, at least in part, on the difference between the actual airflow rate and the expected airflow rate may include: reducing the virtual flow rate when the actual airflow rate is less than the expected airflow rate.

In one aspect of the general embodiment, determining an expected airflow rate through an air subsystem of the downhole heated fluid generation system may include: determining an air-to-fuel ratio based, at least in part, on the input indicative of the desired quality of the heated fluid; and calculating the expected airflow rate based on the air-to-fuel ratio and the virtual flow rate of the heated fluid.

In one aspect of the general embodiment, the method may further include calculating an expected fuel flow rate based on the air-to-fuel ratio and at least one of the expected airflow rate or the virtual flow rate of the heated fluid.

In one aspect of the general embodiment, controlling a plurality of subsystems of the downhole heated fluid generation system with the virtual flow rate of the heated fluid may include: determining an expected treatment fluid flow rate through a treatment fluid subsystem of the downhole heated fluid generation system based, at least in part, on the virtual flow rate of the heated fluid; determining an actual treatment fluid flow rate through the treatment fluid subsystem; and adjusting the virtual flow rate of the heated fluid based, at least in part, on the actual treatment fluid flow rate and the expected treatment fluid flow rate.

In one aspect of the general embodiment, the method may further include receiving a feedback from at least one of the plurality of subsystems indicative of a parameter of the subsystem; and adjusting the virtual flow rate of the heated fluid based, at least in part, on the feedback.

In one aspect of the general embodiment, the method may further include comparing the feedback indicative of the parameter of the subsystem to a setpoint of the parameter; determining a difference between the feedback and the setpoint; and adjusting the virtual flow rate of the heated fluid based, at least in part, on the determined difference between the feedback and the setpoint.

In one aspect of the general embodiment, adjusting the virtual heated fluid generation rate based at least partially on the determined difference between the feedback and the setpoint may include reducing the virtual heated fluid generation rate based on the determined difference between the feedback and the setpoint being below a threshold value.

In one aspect of the general embodiment, the heated fluid includes steam.

In one aspect of the general embodiment, the input indicative of a desired quality of the heated fluid may include a value indicative of steam quality between 0% and 100%.

In one aspect of the general embodiment, the method may further include combusting an airflow and a fuel in a downhole combustor of the downhole heated fluid generation system to generate heat; and generating the steam by applying the generated heat to a treatment fluid supplied to the downhole combustor.

In one aspect of the general embodiment, controlling a plurality of subsystems of the downhole heated fluid generation system with the virtual flow rate of the heated fluid may include controlling all of the subsystems of the downhole heated fluid generation system with the virtual flow rate of the heated fluid, each of the subsystems having a corresponding rate of response.

In one aspect of the general embodiment, the method may further include maintaining the virtual flow rate of the heated fluid to control each of the subsystems at a rate less than a slowest corresponding rate of response of the subsystems.

In another general embodiment, a downhole heated fluid generation system includes: a plurality of subsystems, including an air subsystem having at least one of an air compressor or an air flow control valve, a fuel subsystem having at least one of a fuel compressor or a fuel flow control valve, a treatment fluid subsystem having a fluid pump; a combustor fluidly coupled to at least one of the plurality of subsystems and operable to provide a heated fluid into at least one of a wellbore or a subterranean zone; and a controller operable to: receiving an input indicative of a desired flow rate of the heated fluid; receiving an input indicative of a desired quality of the heated fluid; determining a virtual flow rate of the heated fluid based, at least in part, on the input indicative of the desired flow rate; and controlling the plurality of subsystems with the virtual flow rate of the heated fluid.

In one aspect of the general embodiment, the controller may be further operable to: determine the virtual flow rate of the heated fluid independent of the input indicative of the desired quality of the heated fluid.

In one aspect of the general embodiment, the controller may be further operable to: determine an expected airflow rate through the air subsystem based, at least in part, on the virtual flow rate of the heated fluid; determine an actual airflow rate through the air subsystem; and adjust the virtual flow rate of the heated fluid based, at least in part, on the actual airflow rate and the expected airflow rate.

In one aspect of the general embodiment, the controller may be further operable to: reduce the virtual flow rate when the actual airflow rate is less than the expected airflow rate.

In one aspect of the general embodiment, the controller may be further operable to: determine an air-to-fuel ratio based, at least in part, on the input indicative of the desired quality of the heated fluid; and calculate the expected airflow rate based on the air-to-fuel ratio and the virtual flow rate of the heated fluid.

In one aspect of the general embodiment, the controller may be further operable to: calculate an expected fuel flow rate through the fuel subsystem based on the air-to-fuel ratio and at least one of the expected airflow rate or the virtual flow rate of the heated fluid.

In one aspect of the general embodiment, the controller may be further operable to: determine an expected treatment fluid flow rate through the treatment fluid subsystem system based, at least in part, on the virtual flow rate of the heated fluid; determine an actual treatment fluid flow rate through the treatment fluid subsystem; and adjust the virtual flow rate of the heated fluid based, at least in part, on the actual treatment fluid flow rate and the expected treatment fluid flow rate.

In one aspect of the general embodiment, the controller may be further operable to: receive a feedback from at least one of the plurality of subsystems indicative of a parameter of the subsystem; and adjust the virtual flow rate of the heated fluid based, at least in part, on the feedback.

In one aspect of the general embodiment, the controller may be further operable to: compare the feedback indicative of the parameter of the subsystem to a setpoint of the parameter; determine a difference between the feedback and the setpoint; and adjust the virtual flow rate of the heated fluid based, at least in part, on the determined difference between the feedback and the setpoint.

In one aspect of the general embodiment, the controller may be further operable to: reduce the virtual heated fluid generation rate based on the determined difference between the feedback and the setpoint being below a threshold value.

In one aspect of the general embodiment, the controller may be further operable to: maintain the virtual flow rate of the heated fluid to control all of the plurality of subsystems at a rate less than a slowest corresponding rate of response of the subsystems.

Moreover, one aspect of a control system for managing a heated fluid generation system according to the present disclosure may include the features of determining a virtual flow rate of a heated fluid based, at least in part, on an input indicative of a desired flow rate; and controlling a plurality of subsystems of the downhole heated fluid generation system with the virtual flow rate of the heated fluid.

A second aspect according to any of the preceding aspects may also include the feature of receiving the input indicative of the desired flow rate of the heated fluid.

A third aspect according to any of the preceding aspects may also include the feature of the heated fluid generated by the downhole heated fluid generation system to inject into at least one of a wellbore or a subterranean zone.

A fourth aspect according to any of the preceding aspects may also include the feature of receiving the input indicative of the desired quality of the heated fluid.

A fifth aspect according to any of the preceding aspects may also include the feature of determining the virtual flow rate of the heated fluid independent of the input indicative of the desired quality of the heated fluid.

A sixth aspect according to any of the preceding aspects may also include the feature of determining an expected airflow rate through an air subsystem of the downhole heated fluid generation system based, at least in part, on the virtual flow rate of the heated fluid.

A seventh aspect according to any of the preceding aspects may also include the feature of determining an actual airflow rate through the air subsystem.

An eighth aspect according to any of the preceding aspects may also include the feature of adjusting the virtual flow rate of the heated fluid based, at least in part, on the actual airflow rate and the expected airflow rate.

A ninth aspect according to any of the preceding aspects may also include the feature of reducing the virtual flow rate when the actual airflow rate is less than the expected airflow rate.

A tenth aspect according to any of the preceding aspects may also include the feature of determining an air-to-fuel ratio based, at least in part, on the input indicative of the desired quality of the heated fluid.

An eleventh aspect according to any of the preceding aspects may also include the feature of calculating the expected airflow rate based on the air-to-fuel ratio and the virtual flow rate of the heated fluid.

A twelfth aspect according to any of the preceding aspects may also include the feature of calculating an expected fuel flow rate based on the air-to-fuel ratio.

A thirteenth aspect according to any of the preceding aspects may also include the feature of calculating an expected fuel flow rate based on at least one of the expected airflow rate or the virtual flow rate of the heated fluid.

A fourteenth aspect according to any of the preceding aspects may also include the feature of determining an expected treatment fluid flow rate through a treatment fluid subsystem of the downhole heated fluid generation system based, at least in part, on the virtual flow rate of the heated fluid.

A fifteenth aspect according to any of the preceding aspects may also include the feature of determining an actual treatment fluid flow rate through the treatment fluid subsystem.

A sixteenth aspect according to any of the preceding aspects may also include the feature of adjusting the virtual flow rate of the heated fluid based, at least in part, on the actual treatment fluid flow rate and the expected treatment fluid flow rate.

A seventeenth aspect according to any of the preceding aspects may also include the feature of receiving a feedback from at least one of the plurality of subsystems indicative of a parameter of the subsystem.

An eighteenth aspect according to any of the preceding aspects may also include the feature of adjusting the virtual flow rate of the heated fluid based, at least in part, on the feedback.

A nineteenth aspect according to any of the preceding aspects may also include the feature of comparing the feedback indicative of the parameter of the subsystem to a setpoint of the parameter.

A twentieth aspect according to any of the preceding aspects may also include the feature of determining a difference between the feedback and the setpoint.

A twenty-first aspect according to any of the preceding aspects may also include the feature of adjusting the virtual flow rate of the heated fluid based, at least in part, on the determined difference between the feedback and the setpoint.

A twenty-second aspect according to any of the preceding aspects may also include the feature of reducing the virtual heated fluid generation rate based on the determined difference between the feedback and the setpoint being below a threshold value.

A twenty-third aspect according to any of the preceding aspects may also include the feature of the heated fluid being steam.

A twenty-fourth aspect according to any of the preceding aspects may also include the feature of the input indicative of a desired quality of the heated fluid having a value indicative of steam quality between 0% and 100%.

A twenty-fifth aspect according to any of the preceding aspects may also include the feature of combusting an airflow and a fuel in a downhole combustor of the downhole heated fluid generation system to generate heat.

A twenty-sixth aspect according to any of the preceding aspects may also include the feature of generating the steam by applying the generated heat to a treatment fluid supplied to the downhole combustor.

A twenty-seventh aspect according to any of the preceding aspects may also include the feature of controlling all of the subsystems of the downhole heated fluid generation system with the virtual flow rate of the heated fluid.

A twenty-eighth aspect according to any of the preceding aspects may also include the feature of each of the subsystems having a corresponding rate of response.

A twenty-ninth aspect according to any of the preceding aspects may also include the feature of maintaining the virtual flow rate of the heated fluid to control each of the subsystems at a rate less than a slowest corresponding rate of response of the subsystems.

Various embodiments of a control system for managing and/or controlling a system for providing heated fluid to a subterranean zone according to the present disclosure may include one or more of the following features. For example, the control system may more efficiently react to dynamically changing parameters, such as, for example, heated fluid quantity and heated fluid quality. The control systems may also ensure that all or most subsystems of a system for treating a subterranean zone using heated fluid are coordinated. For instance, the control system may ensure coordination between such subsystems (e.g., a compressor subsystem, an air valve subsystem, a fuel valve subsystem) by coupling (i.e., fully or partially) one or more inputs into the control system. Further, the control system may reduce waste heat and lost energy from a system for treating a subterranean zone using heated fluid. As another example, the control system may control one or more components of the subsystems while minimizing energy (e.g., fluid) losses due to, for instance, pressure changes through such components. In addition, the control system may utilize a combination of feedback and feed forward control loops to control one or more subsystems of system for treating a subterranean zone using heated fluid.

Various embodiments of a control system for managing and/or controlling a system for providing heated fluid to a subterranean zone according to the present disclosure may also include one or more of the following features. The control system may control the components of a system for providing heated fluid to a subterranean zone (e.g., a downhole steam generation system) to account for system inertia. The control system may provide for coupled control of a compressor and valve combination used in a downhole steam operation using a single, nested control loop to more efficiently provide heat fluid to a subterranean zone. The control system may also operate to decouple a desired steam quality parameter from a steam flow rate parameter to control a downhole steam generation system. Further, the control system may also allow for a system for providing heated fluid to a subterranean zone to automatically adjust (e.g., reduce) a virtual heated fluid generation rate to help eliminate and/or balance around system bottlenecks. For example, the control system may provide for substantial synchronization among the subsystems of a downhole steam generation system. As another example, the control system may not be driven by errors in one or more subsystems and/or components of the system for providing heated fluid to a subterranean zone (i.e., a lagging system), but instead may look forward.

FIG. 1 illustrates an example embodiment of a heated fluid generation system 100. System 100 may be used for treating resources in a subterranean zone for recovery using heated fluid that may be used in combination with other technologies for enhancing fluid resource recovery. In this example, the heated fluid comprises steam (of 100% quality or less). In certain instances, the heated fluid can include other liquids, gases or vapors in lieu of or in combination with the steam. For example, in certain instances, the heated fluid includes one or more of water, a solvent to hydrocarbons, and/or other fluids. In the example of FIG. 1, a vertical well bore 102 extends from a terranean surface 104 and intersects a subterranean zone 110, although the vertical well bore 102 may span multiple subterranean zones 110.

A portion of the vertical well bore 102 proximate to a subterranean zone 110 may be isolated from other portions of the vertical well bore 102 (e.g., using packers 156 or other devices) for treatment with heated fluid at only the desired location in the subterranean zone 110. Alternately, the vertical well bore 102 may be isolated in multiple portions to enable treatment with heated fluid at more than one location (i.e., multiple subterranean zones 110) simultaneously or substantially simultaneously, sequentially, or in any other order.

The length of the vertical well bore 102 may be lined or partially lined with a casing (not shown). The casing may be secured therein such as by cementing or any other manner to anchor the casing within the vertical well bore 102. However, casing may omitted within all or a portion of the vertical well bore 102. Further, although the vertical well bore 102 is illustrated as a vertical well bore, the well bore 102 may be substantially (but not completely) vertical, accounting for drilling technologies used to form the vertical well bore 102.

In the illustrated embodiment, the vertical well bore 102 is coupled with a directional well bore 106, which, as shown, includes a radiussed portion and a substantially horizontal portion. Thus, in the illustrated embodiment, the combination of the vertical well bore 102 and the directional well bore 106 forms an articulated well bore extending from the terranean surface 104 into the subterranean zone 110. Of course, other configurations of well bores are within the scope of the present disclosure, such as other articulated well bores, slant well bores, horizontal well bores, directional well bores with laterals coupled thereto, and any combination thereof.

As illustrated, heated fluid 108 is introduced into the well bore portions and, ultimately, into the subterranean zone 110 by heated fluid generator 112. The heated fluid generator 112 shown in FIG. 1 is a downhole heated fluid generator, although the heated fluid generator 112 may additionally or alternatively include a surface based heated fluid generator. In certain embodiments, the heated fluid generator 112 can include a catalytic combustor that includes a catalyst that promotes an oxidization reaction of a mixture of fuel and air without the need for an open flame. That is, the catalyst initiates and sustains the combustion of the fuel/air mixture.

Alternately (or additionally), the heated fluid generator 112 may include one or more other types of combustors. Some examples of combustors (but not exhaustive) include, a direct fired combustor where the fuel and air are burned at burner and the flame from the burner heats a boiler chamber carrying the treatment fluid, a combustor where the fuel and air are combined in a combustion chamber and the treatment fluid is introduced to be heated by the combustion, or any other type combustor. In some instances, the combustion chamber can be configured as a pressure vessel to contain and direct pressure from the expansion of gasses during combustion to further pressurize the heated fluid and facilitate its injection into the subterranean zone 110. Expansion of the exhaust gases resulting from combustion of the fuel and air mixture in the combustion chamber provides a driving force at least partially responsible for heating and/or driving the treatment fluid into a region of the directional well bore 106 at or near the subterranean zone 110. The heated fluid generator 112 may also include a nozzle at an outlet of the combustion chamber to inject the heated fluid 108 into the well bore portions and/or subterranean zone 110.

The heated fluid generation system 100 includes surface subsystems, such as an air subsystem 118, a fuel subsystem 124, and a treatment fluid subsystem 140. As illustrated, the air subsystem 118, the fuel subsystem 124, and the treatment fluid subsystem 140 provide an air supply 120, a fuel supply 126, and a treatment fluid 142 (e.g., water, hydrocarbon, or other fluid), respectively, to a flow control manifold 114. The respective air supply 120, fuel supply 126, and treatment fluid 142 is apportioned and supplied to the heated fluid generator 112 by and/or through the flow control manifold 114 and through an air conduit 144, a fuel conduit 146, and a treatment fluid conduit 148, respectively. Further control (e.g., throttling) of the air supply 120, fuel supply 126, and treatment fluid 142 may be accomplished by an airflow control valve 150, a fuel flow control valve 152, and a treatment fluid flow control valve 154 positioned in the respective air conduit 144, fuel conduit 146, and treatment fluid conduit 148.

The airflow control valve 150, fuel flow control valve 152, and treatment fluid flow control valve 154 are illustrated as downhole flow control components within the vertical well bore 102. Alternatively, one or more of the airflow control valve 150, fuel flow control valve 152, and treatment fluid flow control valve 154 may be configured up hole within their respective conduits (e.g., above and/or at the terranean surface 104).

In some embodiments, one or more of the airflow control valve 150, fuel flow control valve 152, and treatment fluid flow control valve 154 may be check or one-way valves on one or more of the respective conduits 144, 146, and 148. The check valves may prevent backflow of the air supply 120, fuel supply 126, and treatment fluid 142 or other fluids contained in the well bore 102, and, therefore, provide for improved safety at a well site during heated fluid treatment. The valves 150, 152, and 154 may also be pressure operated check valves. For example, the valves 152 and 150 may be pressure operated valves that are maintained in an opened position, permitting the supply fuel and supply air 126 and 120, respectively, to flow to the heated fluid generator 112 so long as the treatment fluid 142 is maintained at a defined pressure. When the pressure of the treatment fluid 142 drops below the defined pressure, the valves 152 and 150 close, cutting off the flows of fuel and air. As a result, the combustion within heated fluid generator 112 may be stopped. This can prevent destruction (e.g., burning) of the heated fluid generator 112 if the treatment fluid 142 is stopped. In such a configuration, treatment fluid 142 (e.g., water) must be flowing to the heated fluid generator 112 in order for fuel and air to be permitted to flow to the heated fluid generator 112.

As illustrated, the air subsystem 118 includes an air compressor 116 in fluid communication with the flow control manifold 114. The supply air 120 is provided to the flow control manifold 114 from the air compressor 116. The air compressor 116 may thus receive an intake of air (or other combustible fluid, such as oxygen) and add energy to the intake flow of air, thereby increasing the pressure of the air provided to the flow control manifold 114. According to some implementations, the compressor 116 includes a turbine and a fan joined by a shaft (not shown) extending through the compressor 116. Air is drawn into an inlet end of compressor and subsequently compressed by the fan. In certain embodiments including a turbine, the air compressor 116 may be a turbine compressor or other types of compressor, including compressors powered by an internal combustion engine.

As illustrated, the fuel subsystem 124 includes a fuel compressor 122 in fluid communication with the flow control manifold 114. The supply fuel 126 (e.g., methane, gasoline, diesel, propane, or other liquid or gaseous combustible fuel) is provided to the flow control manifold 114 from the fuel compressor 122. The fuel compressor 122 may thus receive an intake of fuel and add energy to the intake flow of fuel, thereby increasing the pressure of the fuel provided to the flow control manifold 114. According to some implementations, the compressor 122 can be a turbine compressor or other type of compressor, including a compressor powered by an internal combustion engine. In some embodiments, the fuel compressor 122 may generate waste heat, such as, for example, by combusting all or a portion of a fuel supplied to the compressor 122. The waste heat may be used to preheat the treatment fluid 142. Additionally, waste heat from other sources (e.g., waste heat from a power plant used to drive a boost pump 128, and other sources of waste heat) may also be used to preheat the treatment fluid 142.

The treatment fluid subsystem 140, as illustrated, includes the boost pump 128 in fluid communication with a treatment fluid source 130 via a conduit 132. In the illustrated embodiment, the treatment fluid source 130 is an open water source, such as seawater or open freshwater. Of course, other treatment fluid sources may be utilized in alternative embodiments, such as, for example, stored water, potable water, or other fluid or combination and/or mixtures of fluids. The boost pump 128 draws a flow of the treatment fluid source 130 through the conduit 132 and supplies the flow to a fluid treatment 134 in the illustrated embodiment. The fluid treatment 134, for example, may clean, filter, desalinate, and/or otherwise treat the treatment fluid source 130 and output a treated treatment fluid 136 to a treatment fluid pump 138. The treated treatment fluid 136 is pumped to the flow control manifold 114 by the treatment fluid pump 138 as the treatment fluid 142.

The flow control manifold 114, as illustrated, receives the supply air 120, the supply fuel 126, and the treatment fluid 142 and provides regulated flows of the supply air 120, the supply fuel 126, and the treatment fluid 142 downhole to the heated fluid generator 112. As illustrated, the flow control manifold 114 receives a control signal 170 from the control hardware 168.

The controller 164 supplies one or more control signal outputs 166 to the control hardware 168. In some embodiments, the controller 164 may be a computer including one or more processors, one or more memory modules, a graphical user interface, one or more input peripherals, and one or more network interfaces. The controller 164 may execute one or more software modules in order to, for example, generate and transmit the control signal outputs 166 to the control hardware 168. The processor(s) may execute instructions and manipulate data to perform the operations of the controller 164. Each processor may be, for example, a central processing unit (CPU), a blade, an application specific integrated circuit (ASIC), or a field-programmable gate array (FPGA). Regardless of the particular implementation, "software" may include software, firmware, wired or programmed hardware, or any combination thereof as appropriate. Indeed, software executed by the controller 164 may be written or described in any appropriate computer language including C, C++, Java, Visual Basic, assembler, Perl, any suitable version of 4GL, as well as others. For example, such software may be a composite application, portions of which may be implemented as Enterprise Java Beans (EJBs) or the design-time components may have the ability to generate run-time implementations into different platforms, such as J2EE (Java 2 Platform, Enterprise Edition), ABAP (Advanced Business Application Programming) objects, or Microsoft's .NET. Such software may include numerous other sub-modules or may instead be a single multi-tasked module that implements the various features and functionality through various objects, methods, or other processes. Further, such software may be internal to controller 164, but, in some embodiments, one or more processes associated with controller 164 may be stored, referenced, or executed remotely.

The one or more memory modules may, in some embodiments, include any memory or database module and may take the form of volatile or non-volatile memory including, without limitation, magnetic media, optical media, random access memory (RAM), read-only memory (ROM), removable media, or any other suitable local or remote memory component. Memory may also include, along with the aforementioned solar energy system installation-related data, any other appropriate data such as VPN applications or services, firewall policies, a security or access log, print or other reporting files, HTML files or templates, data classes or object interfaces, child software applications or subsystems, and others.

The controller 164 communicates with one or more components of the heated fluid generation system 100 via one or more interfaces. For example, the controller 164 may be communicably coupled to one or more controllers of the air subsystem 118, the fuel subsystem 124, and the treatment fluid subsystem 140, as well as the control hardware 168. For example, the controller 164 may be a master controller communicably coupled to, and operable to control, one or more individual subsystem controllers (or component controllers). The controller 164 may also receive data from one or more components of the heated fluid generation system 100, such as the flow control manifold 114 (via manifold feedback 162), the sensor 158 (via sensor feedback 160), as well as the subsystems 118, 124, and 140. In some embodiments, such interfaces may include logic encoded in software and/or hardware in a suitable combination and operable to communicate through one or more data links. More specifically, such interfaces may include software supporting one or more communications protocols associated with communication networks or hardware operable to communicate physical signals to and from the controller 164.

In some embodiments, the controller 164 may provide an efficient method of safely controlling the supply fuel, the supply air, and the treatment fluid (e.g., heated water, steam, and/or a combination thereof) water injection for downhole steam generation. The controller 164 may also greatly reduce failures that could occur by using separate controllers or a manual control system. During the steam generation process air, gas, and water are pumped downhole where the fuel is burned and the energy generated is used to heat the water into a partial phase change. To automate this process the flow of air, gas and fuel may be controlled and sensors at those inputs may be combined with those downhole (e.g., sensor 158) in the proximity of the burn chamber and used as feedback to the controller 164.

Figure 2:
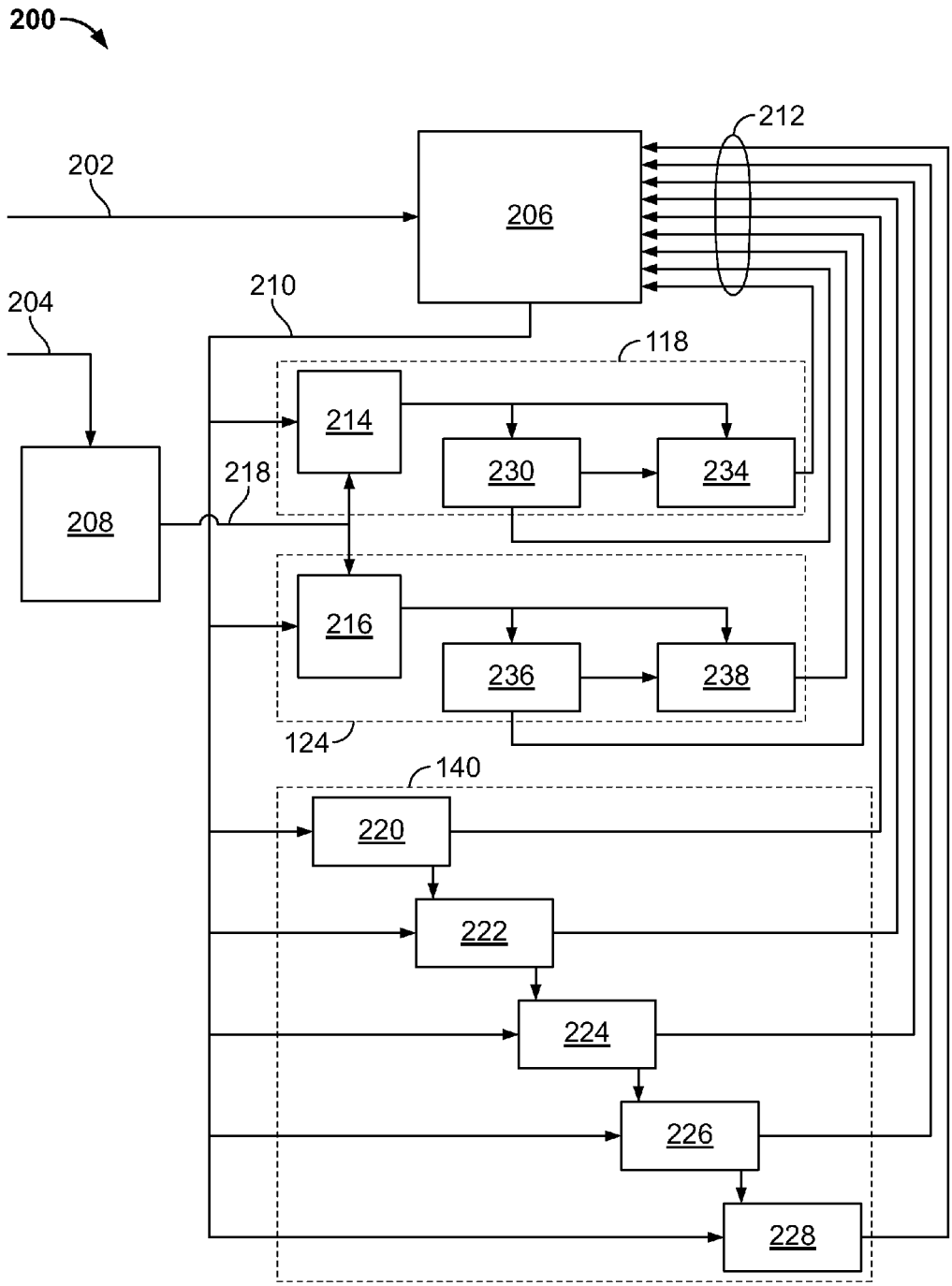
FIG. 2 illustrates a block diagram of an example embodiment of a control system for managing and/or controlling a heated fluid generation system.

FIG. 2 illustrates a block diagram of an example embodiment of a control system 200 for managing and/or controlling a heated fluid generation system, such as the heated fluid generation system 100. In some embodiments, the control system 200 may be implemented in the controller 164, the control hardware 168, one or more of the subsystems 118, 124, and 140, and/or the flow control manifold 114. As illustrated, the control system 200 includes a virtual treatment fluid system 206 that receives a treatment fluid input rate 202 (e.g., a desired rate input) by an operator of the control system 200 and a plurality of subsystem feedback values 212 and outputs a virtual fluid generation rate 210. In some embodiments, the virtual system 206 is executed on and/or by the controller 164 and describes or represents (virtually) a control system for a heated fluid generation system, such as the heated fluid generation system 100. For example, the virtual system 206 may create the virtual fluid generation rate 210 based on, for instance, the treatment fluid input rate 202 and the plurality of subsystem feedback values 212, and couple one or more subsystems while allowing each particular subsystem to reduce the virtual rate 210, individually, if the rate 210 exceeds an ability of the particular subsystem to keep up. Thus, the virtual system 206 may balance all the bottlenecks and keep the heated fluid generation system running smoothly.

As illustrated, the control system 200 includes the air subsystem 118, including an air compressor 230 and an air valve 234. In some embodiments, the air compressor 230 may represent the air compressor 116 shown in FIG. 1, while the air valve 234 may represent the airflow control valve 150, an airflow valve within the flow control manifold 114, and/or another air valve within the air subsystem 118. The control system 200 also includes the fuel subsystem 124 including a fuel compressor 236 and a fuel valve 238. In some embodiments, the fuel compressor 236 may represent the fuel compressor 122 shown in FIG. 1, while the fuel valve 238 may represent the fuel flow control valve 152, a fuel valve within the flow control manifold 114, and/or another fuel valve within the fuel subsystem 124.

The control system 200 also includes the treatment fluid subsystem 140 including a fluid pump 220, one or more filtration tanks 222, a first treatment stage 224 (e.g., a reverse osmosis treatment), a second treatment stage 226 (e.g., an ion exchange treatment), and a treated fluid pump 228. In some embodiments, the fluid pump 220, the filtration tanks 222 and treatment stages 224/226, and the treated fluid pump 228 may represent the boost pump 128, the fluid treatment 134, and the treatment fluid pump 138, respectively, illustrated in FIG. 1. At a high level, these components of the treatment fluid subsystem 140 may be controlled by the control system 200 in order to supply an adjustable flow of a treatment fluid (e.g., a heated fluid such as hot water, steam, or a combination thereof) to a downhole combustor, such as the heated fluid generator 112 shown in FIG. 1. Thus, flow quantities of the treatment fluid, air, and fuel may be supplied downhole at rates determined and controlled by the control system 200 in order to treat a subterranean zone with heated fluid.

The illustrated embodiment of the control system 200 also includes a fluid quality control 208, which receives a treatment fluid quality 204 (e.g., a desired quality input by an operator of the control system 200) as an input and provides a corrected treatment fluid quality 218 that, for example, accounts for an actual fluid quality (e.g., steam quality) measured downhole. For example, at a high level, the fluid quality control 208 may sweep of input parameter and monitor an output parameter to estimate the actual fluid quality and, thus, system health of the heated fluid generation system. As one example, fuel and air inputs to the subsystems 118 and 124, respectively, are increased while downhole fluid temperature and pressure is monitored (e.g., by the sensor 158). From the temperature and pressure data, a transition from, for instance, water into mixed water-steam and from mixed water-steam to pure steam, can be observed.

As illustrated, the treatment fluid rate 202 is input to the virtual treatment fluid system 206, which provides the virtual fluid generation rate 210 to an air ratio control 214, a fuel ratio control 216, as well as the components 220 through 228 of the treatment fluid subsystem 140, based on one or more of the feedback values 212. Thus, the virtual system 206 may drive the subsystems 118, 124, and 140 through the virtual fluid generation rate 210 in order to maintain substantial synchronization of all of the subsystems within the heated fluid generation system. In addition, the corrected treatment fluid quality 218 (determined by the fluid quality control 208 based on the desired treatment fluid quality 204) is also input into the air ratio control 214. Based on the input virtual fluid generation rate 210 and the corrected treatment fluid quality 218, the air ratio control 214 determines an airflow rate to meet the virtual fluid generation rate 210. The corrected treatment fluid quality 218 is also input into the fuel ratio control 216. Based on the input virtual fluid generation rate 210 and the corrected treatment fluid quality 218, the fuel ratio control 216 determines a fuel flow rate to meet the virtual fluid generation rate 210.

The airflow rate is provided to the air compressor 230 and the air valve 234 to, for example, drive the air compressor 230 at a particular rate (e.g., an RPM, a pressure, or otherwise) and drive the air valve 234 to a particular position (e.g., 20% open, 40% open, and other positions). In other words, the airflow rate (as determined according to the input virtual fluid generation rate 210 and the corrected treatment fluid quality 218) may be a setpoint to which the air compressor 230 and air valve 234 work to meet. The air compressor 230, at the particular rate set by the airflow rate, and the air valve 234, at the particular position set by the airflow rate, will work in conjunction to provide a set airflow rate. That rate and position of the air compressor 230 and air valve 234, respectively, may then be provided as feedback values 212 to the virtual system 206. For example, as described below, the air subsystem 218 (through the feedback values of the air compressor 230 and/or air valve 234) may provide a proportional term (e.g., of a proportional-integral-derivative ("PID") controller) to the virtual treatment fluid system 206. In some embodiments, as described more fully below, this proportional term may be used as a feed forward term.

The fuel flow rate is provided to the fuel compressor 236 and the fuel valve 238 to, for example, drive the fuel compressor 236 at a particular rate (e.g., an RPM, a pressure, or otherwise) and drive the fuel valve 238 to a particular position (e.g., 20% open, 40% open, and other positions). The fuel compressor 236, at the particular rate set by the fuel flow rate, and the fuel valve 238, at the particular position set by the fuel flow rate, will work in conjunction to provide a set fuel flow rate. That rate and position of the fuel compressor 230 and fuel valve 234, respectively, may then be provided as feedback values 212 to the virtual system 206. Like the air subsystem 218, and as described below, the fuel subsystem 124 (through the feedback values of the fuel compressor 236 and/or fuel valve 238) may provide a proportional term (e.g., of a PID controller) to the virtual treatment fluid system 206. In some embodiments, as described more fully below, this proportional term may also be used as a feed forward term, along with the proportional term from the air subsystem 218.

As described above, the virtual fluid generation rate 210 may be fed to each of the components of the treatment fluid subsystem 140 to drive the particular components of the subsystem 140. For example, the virtual fluid generation rate 210 may, as illustrated, be provided to each individual component: the fluid pump 220, the filtration tanks 222, the first treatment stage 224, the second treatment stage 226, and the treated fluid pump 228. The rate 210 may thus act as a setpoint to control one or more of the components of the treatment fluid subsystem 140. Each of the aforementioned components of the subsystem 140 may provide feedback values to the virtual treatment fluid system 206. As illustrated, each of the components of the treatment fluid subsystem 140 may provide feedback to the next component within the process. For instance, the fluid pump 220 may provide feedback values (e.g., pump speed, pressure, or other value) to the filtration tanks 222. The filtration tanks 222 may provide feedback values (e.g., flow rate entering and/or exiting the tanks). The first treatment stage 224 may provide feedback values (e.g., flow rates, fluid quality, or other values) to the second treatment stage 226. The second treatment stage 226 may provide feedback values (e.g., flow rates, fluid quality, or other values) to the treated fluid pump 228. In such fashion, one or more of the components of the treatment fluid subsystem 140 may operate according to the "setpoint" (i.e., the virtual fluid generation rate 210) and be responsive to the preceding component in the process of the subsystem 140.

In operation, by providing the virtual fluid generation rate 210 as a driving setpoint to each of the subsystems (i.e., the air subsystem 118, the fuel subsystem 124, and the treatment fluid subsystem 140), the subsystems are operated to achieve a common goal, or setpoint. This setpoint, i.e., the virtual fluid generation rate 210, is set by the user by providing the desired treatment fluid rate 202 to the virtual system 206, and adjusted according to the subsystem feedback values 212. The effect of the subsystem feedback values 212 may thus be to adjust and/or change the virtual fluid generation rate 210 if a particular subsystem (or component within a particular subsystem) cannot meet the setpoint (i.e., cannot meet the virtual fluid generation rate 210). In such cases, the virtual system 206 will adjust the virtual fluid generation rate 210, such as, for example, by reducing the rate 210 and "slowing" the entire system. Thus, the virtual system 206 may ensure that the subsystems 118, 124, and 140 (as well as other subsystems) remain synchronized.

In some embodiments, the virtual fluid generation rate 210 may act as an "inertia" provided to the subsystems 118, 124, and 140 in order to achieve the desired treatment fluid rate 202 (e.g., steam flow rate) and/or the desired treatment fluid quality 204 (e.g., steam quality) provided by an operator. For instance, the virtual fluid generation rate 210 may initially represent a predicted virtual inertia of the overall system (i.e., the combination of the subsystems 118, 124, and 140). The virtual fluid generation rate 210, as an inertia, may be virtually moved according to the subsystem feedback values 212 to eventually reach an actual inertia of the overall system. For instance, each of the subsystems 118, 124, and 140 may be connected to the virtual inertia—as the virtual inertia moves (e.g., speeds up), one or more of the subsystems 118, 124, and 140 may also move (e.g., compressors, pumps, and other components may operate at higher rotational speeds). The virtual inertia, moreover, may determine a maximum acceleration of the system 200 (i.e., how fast the system 200 may be sped up to produce a heated fluid at desired properties) with, for example, an applied torque through the controller 164 and/or a negative torque feedback via the subsystem feedback values 212). At the actual inertia, for example, each of the subsystems 118, 124, and 140 (as well as the components of the subsystems) may be able to operate to achieve the desired treatment fluid rate 202 and/or the desired treatment fluid quality 204.

Figure 3:
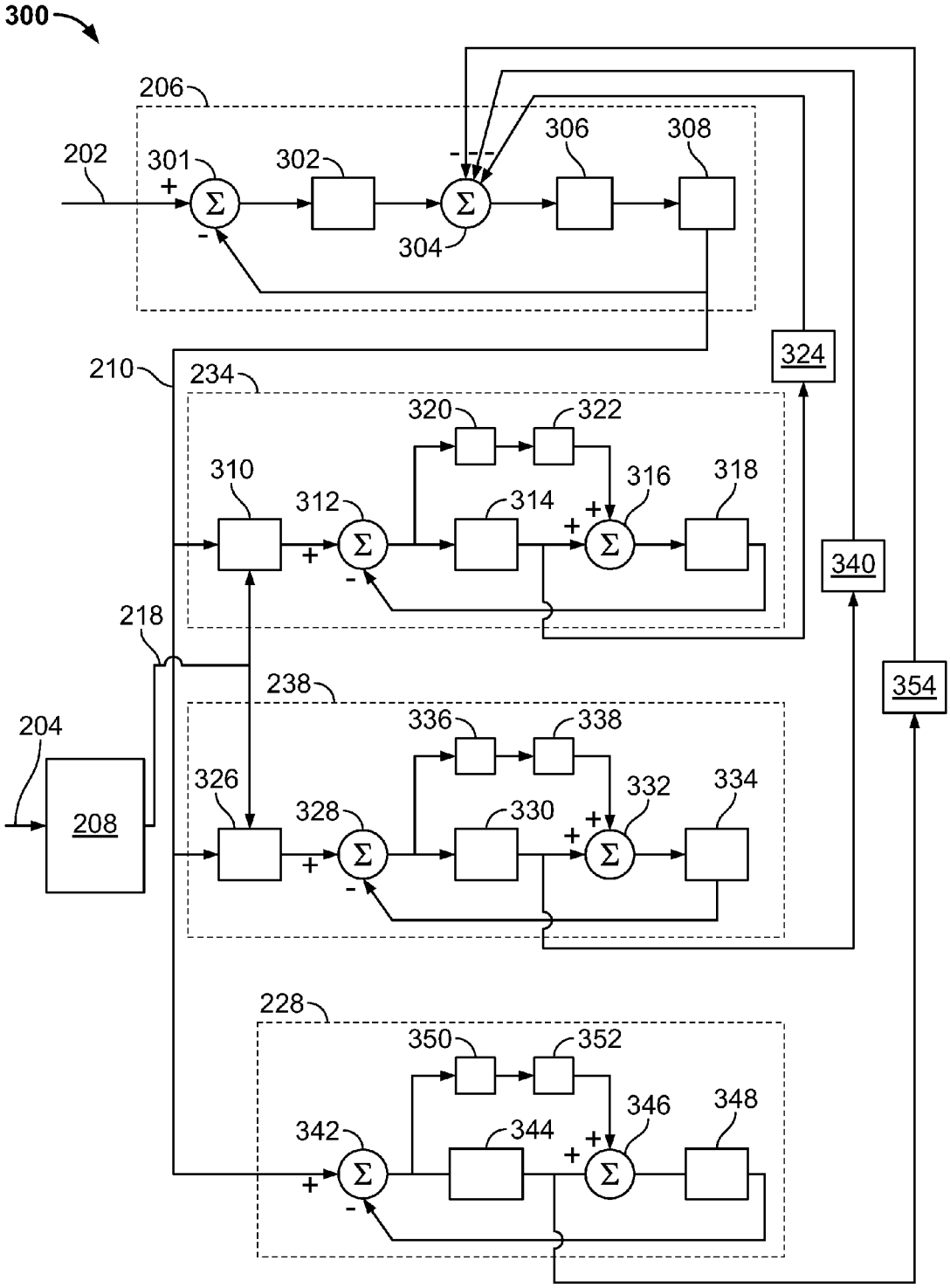
FIG. 3 illustrates a schematic diagram of an example embodiment of a control system for managing and/or controlling a heated fluid generation system.

FIG. 3 illustrates a schematic diagram of an example embodiment of a control system 300 for managing and/or controlling a heated fluid generation system. In some embodiments, the control system 300 may be used, for example, with the heated fluid generation system 100 through the controller 164. Generally, the control system 300 illustrates one example embodiment for a self-balancing virtual heated fluid (e.g., steam, hot water, or other heated fluid) rate control. As illustrated, the control system 300 includes the virtual treatment fluid system 206, which feeds the virtual fluid generation rate 210 to an air subsystem 234, a fuel subsystem 238, and a fluid pump subsystem 228. At a high level, the virtual system 206 utilizes feedback values 324, 340, and 354 from the air valve subsystem 234, the fuel subsystem 238, and the fluid pump subsystem 228, respectively, as well as the desired treatment fluid rate 202 (e.g., from an operator) to control the heated fluid generation system response. For instance, the feedbacks 324, 340, and/or 354 may act to slow the heated fluid generation system response when one or more of the subsystems 234, 238, and 228 cannot achieve the virtual fluid generation rate 210 output from the virtual treatment fluid system 206.

As illustrated, virtual treatment fluid system 206 receives the desired treatment fluid rate 202 and compares the rate 202, through a summing (or other) function 301, to the virtual fluid generation rate 210 (i.e., the output of the virtual treatment fluid system 206). The result of the function 301 is then adjusted according to a proportional coefficient 302. In some embodiments, the proportional coefficient 302 may be a controller term (i.e., of the controller executing the virtual treatment fluid system 206) that defines a response of the entire heated fluid generation system. For example, the response of the entire heated fluid generation system may be set to be slower than one or more (and preferably all) of the individual controllers for the subsystems 234, 238, and 228 (as well as other subsystems, if necessary). Thus, the individual subsystems 234, 238, and 228 (as well as other subsystems) may be ramped up and/or down together by adjusting the desired treatment fluid rate 202.

The adjusted fluid generation rate, as illustrated, is then further adjusted by a summing (or other) function 304 according to the feedback values 324, 340, and 354 received from the respective subsystems 234, 238, and 228 (described more below). By adjusting the fluid generation rate according to the feedback values 324, 340, and 354, the heated fluid generation system response may be adjusted (e.g., slowed) when one or more of the respective subsystems 234, 238, and 228 (or other subsystems) cannot achieve the desired rates and/or experience a problem or malfunction. For example, if the air subsystem 234 (e.g., a valve and/or air compressor component) is unable to supply the required rate and/or pressure of air for the heated fluid generation system, then this feedback subsystem will feed back through the feedback term 324 and will reduce the virtual fluid generation rate 210 until all the subsystems are working in unison at the maximum rate that the air can supply. As another example, if a fluid source (e.g., a tub, tank, or other source) is being substantially reduced, the fluid pumping rate may be reduced, resulting in a reduction in the feedback term 354. Reduction in the feedback term 354 may then (through the virtual treatment fluid system 206 and virtual fluid generation rate 210) reduce the rate of the entire system to maintain balance in all inputs. In other words, the control system 300 may operate to ensure that the entire system reacts (and responds) no faster than the slowest subsystem.

The fluid generation rate may then be further adjusted according to a virtual inertia 306. In some embodiments, the virtual inertia 306 may be predetermined and/or set by a user (e.g., an operator of the control system 300). In some embodiments, the virtual inertia 306 may help provide for a maximum rate of response of the controller executing the virtual treatment fluid system 206 (i.e., a top level controller, such as the controller 164) to ensure that the top level controller response does not exceed the response rates of one or more subsystem controllers.

The fluid generation rate may then be further adjusted according to an error integration function 308. For example, in some embodiments, the error integration function 308 may be a function (e.g., a first order function) that smooths out the rate of changes of the subsystems, such as the subsystems 234, 238, and 228 illustrated in FIG. 3. For example, in some aspects the error integration function 308 may smooth out noise in the virtual fluid generation rate signal.

The virtual fluid generation rate 210 is output from the virtual treatment fluid system 206 as a feed forward rate to the subsystems 234, 238, and 228, and also as a feedback rate to the function 301. More specifically, the virtual fluid generation rate 210 is provided to an air ratio control 310 and a fuel ratio control 326, along with the corrected treatment fluid quality 218. Control system 300, as illustrated, also includes the fluid quality control 208, which receives a treatment fluid quality 204 (e.g., a desired quality input by an operator of the control system 200) as an input and provides a corrected treatment fluid quality 218 that, for example, accounts for an actual fluid quality (e.g., steam quality) measured downhole.

Based on the virtual fluid generation rate 210 and the corrected treatment fluid quality 218, the air ratio control 310 determines an airflow rate that is provided to the summing (or other) function 312. The airflow rate is compared to a feedback actual airflow rate through a valve 318 of the air valve subsystem 234. As illustrated, the air subsystem 234 may be controlled by a proportional-integral ("PI") control, with the error determined by the comparison of the airflow rate and the feedback actual airflow rate through the valve 318. The integral term includes an error integration function 320 and an integral gain 322. The integral term is then added, through the summing (or other) function 316, to a proportional term 314. The proportional term 314 is also provided as the feedback 324 to the function 304. In some embodiments, the feedback 324 includes a balancing coefficient that, for example, scales the proportional term 314 to a virtual inertia term so that the proportional term 314 can be compared (i.e., on the same scale) to other feedback terms (such as feedbacks 340 and 354).

Based on the virtual fluid generation rate 210 and the corrected treatment fluid quality 218, the fuel ratio control 326 determines a fuel flow rate that is provided to a summing (or other) function 328. The desired fuel flow rate is compared to a feedback actual fuel flow rate through a valve 334 of the fuel subsystem 238. As illustrated, the fuel subsystem 238 may also be controlled by a PI control, with the error determined by the comparison of the desired fuel flow rate and the feedback actual fuel flow rate through the valve 334. The integral term includes an error integration function 336 and an integral gain 338. The integral term is then added, through the summing (or other) function 332, to a proportional term 330. The proportional term 330 is also provided as the feedback 340 to the function 304. In some embodiments, the feedback 340 includes a balancing coefficient that, for example, scales the proportional term 330 to a virtual inertia term so that the proportional term 330 can be compared (i.e., on the same scale) to other feedback terms (such as feedbacks 324 and 354).

As illustrated for both of the air subsystem 234 and the fuel subsystem 238, the respective summing functions 316 and 332 provide revised setpoints (e.g., valve positions) to the respective valves 318 and 334. The revised setpoints are based on the integral and proportional terms in the respective PI controllers. In alternative embodiments, however, one or more of the illustrated subsystems (including the air subsystem 234 and the fuel subsystem 238) may utilize other forms of control, such as, for example, PID control, linear-quadratic-Gaussian (LQG) control, linear-quadratic regulator (LQR) control, lead-lag control, or other form of control.

The virtual fluid generation rate 210 is also fed forward to the fluid pump subsystem 228. A desired treatment fluid flow rate may be derived from the virtual fluid generation rate 210, such as, for example, through predetermined data regarding the type of fluid (e.g., density and other data). The desired treatment fluid flow rate is compared, through the summing (or other) function 342 to an actual treatment fluid flow rate from a pump 348 of the fluid pump subsystem 228 to determine an error (i.e., deviation between desired and actual flow rates). As illustrated, the fluid pump subsystem 228 may also be controlled by a PI control. The integral term includes an error integration function 350 and an integral gain 352. The integral term is then added, through the summing (or other) function 346, to a proportional term 344. The proportional term 344 is also provided as the feedback 354 to the function 304. In some embodiments, the feedback 354 includes a balancing coefficient that, for example, scales the proportional term 344 to a virtual inertia term so that the proportional term 344 can be compared (i.e., on the same scale) to other feedback terms (such as feedbacks 324 and 340).

Figure 4:
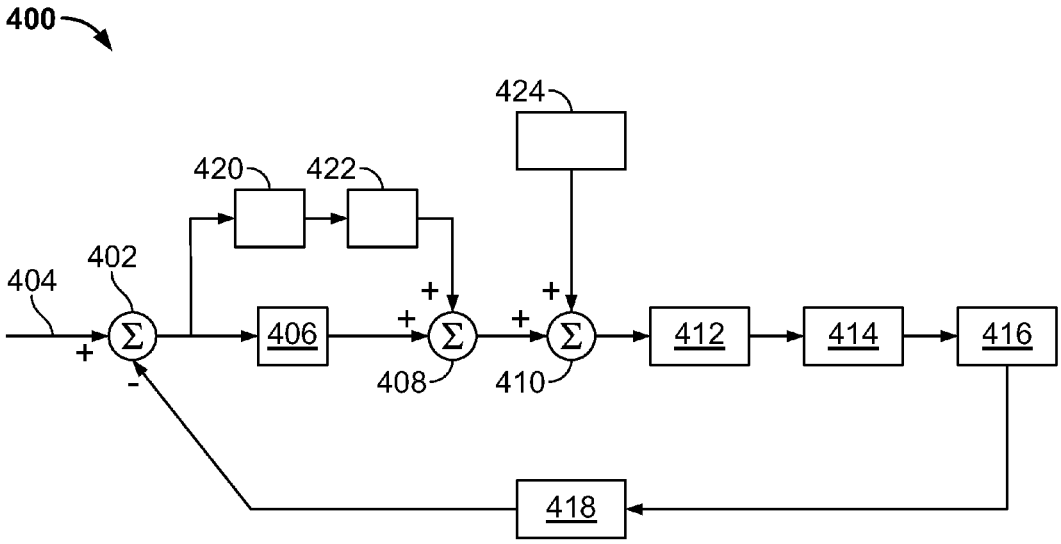
FIG. 4 illustrates a schematic diagram of an example embodiment of a control system for managing and/or controlling a portion of a heated fluid generation system.

FIG. 4 illustrates a schematic diagram of an example embodiment of a control system 400 for managing and/or controlling a portion of a heated fluid generation system, such as the heated fluid generation system 100 shown in FIG. 1. For example, the control system 400 may be used to control a compressor of the heated fluid generation system 100, such as, for example, the air compressor 116, and/or the fuel compressor 122. Moreover, in some embodiments, the control system 400 may be a part of, for example, nested within, the control subsystem of one of the air subsystem 234 and/or the fuel subsystem 238.

In the illustrated embodiment, a compressor 414 (e.g., air or fuel) may be a source of energized gas and a valve 416 (e.g., air or fuel) may be a control mechanism. An optimal way to save energy would be to use the compressor without a valve, as there would be no energy losses as the air or fuel passes through the valve. This scenario (e.g., a valve-less subsystem) may be impractical since the inertia of a compressor is large and difficult to accelerate. Thus, the subsystem may be designed such that the valve can be used to adjust the flow (e.g., of air or fuel) with minimal energy losses to the fluid. The valve, therefore, may be preferably operated within a range that leaves the valve mostly open while its behavior is still within its linear range. The control in such a design may be divided between the compressor and the valve, with the compressor having a response time slower (e.g., slower by an order of magnitude) than the valve so that control of these components will not compete and become unstable.

As illustrated, a desired average valve position 404 is compared at a summing (or other) function 402 to an actual valve position of the valve 416. In some embodiments, as illustrated, the actual valve position may be filtered through an frequency-weighted filter 418 (e.g., an averaging filter) before being compared to the desired valve position 404. For example, the frequency-weighted filter 418 may be a high frequency filter that removes valve noise and captures an average valve position value.

In the illustrated embodiment of FIG. 4, the compressor control input is a combination of feedback and feed forward control. In some embodiments (such as the illustrated embodiment), the control may be PI control. Alternatively, other control schemes, such as PID or otherwise, may be utilized. The PI control of system 400 includes an integral term including an error integration function 420 and an integral gain 422. The integral and proportional terms are then added, through the summing (or other) function 408 to account for the total error between desired valve position 404 and the actual position of the valve 416. A summing function 410 may then be applied to account for a decoupling term transfer function 424. As illustrated, the decoupling term transfer function 424 may be a feed forward decoupling term, which may be determined according to, for example, a well pressure (e.g., of the wellbore 102 and/or at the wellhead of the wellbore 102) and a desired fluid flow rate (e.g., of air or fuel). From the summing function 410, a compressor setpoint pressure is fed to a compressor controller 412. The compressor controller 412 then adjusts (e.g., speeds up/slows down) the compressor 414 to meet the compressor setpoint pressure. The compressor pressure (e.g., actual) is then fed to the valve 416. In some embodiments, the valve 416 may adjust its position based on, at least partially, the actual compressor pressure.

Figure 5:
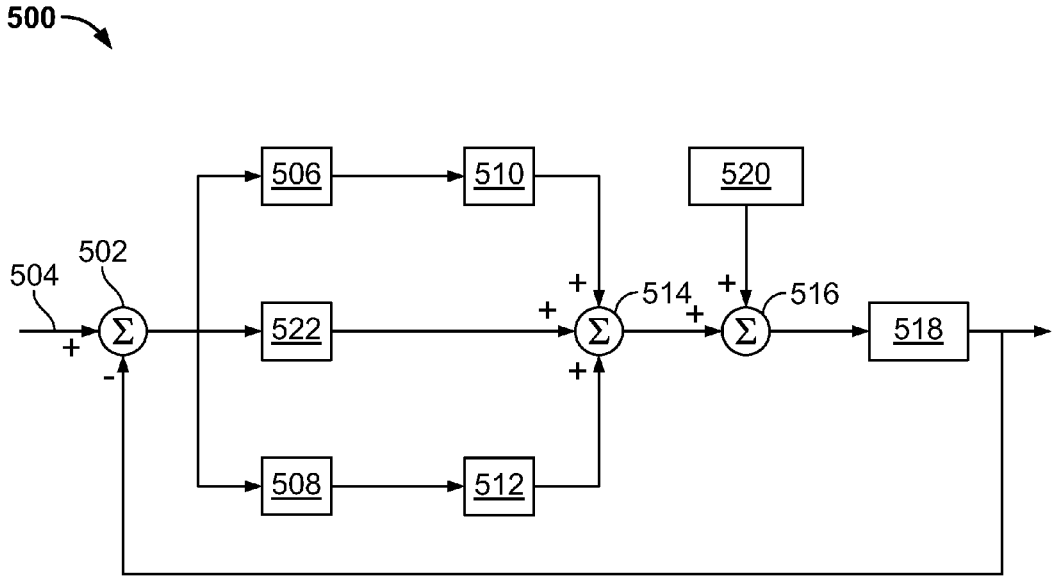
FIG. 5 illustrates a schematic diagram of an example embodiment of a control system for managing and/or controlling another portion of a heated fluid generation system.

FIG. 5 illustrates a schematic diagram of an example embodiment of a control system 500 for managing and/or controlling another portion of a heated fluid generation system, such as the heated fluid generation system 100 shown in FIG. 1. For example, the control system 500 may be used to control a valve of the heated fluid generation system 100, such as, for example, the airflow control valve 150 (or other air valve), and/or the fuel flow control valve 152 (or other fuel valve). Moreover, in some embodiments, the control system 500 may be a part of, for example, nested within, the control subsystem of one of the air subsystem 234 and/or the fuel subsystem 238.

In the illustrated embodiment of FIG. 5, the valve control input is a combination of feedback and feed forward control. In some embodiments (such as the illustrated embodiment), the control may be PID control. Alternatively, other control schemes, such as PI or otherwise, may be utilized. As another example, the control scheme may be implemented by a controller utilizing a state space scheme (e.g., a time-domain control scheme) representing a mathematical model of a physical system as a set of input, output and state variables related by first-order differential equations. For example, inputs to the state space model may include a desired heated fluid flow rate, a desired heated fluid quality, or other inputs described in the present disclosure. Outputs of the state space model may include, for instance, the virtual heated fluid generation rate or other outputs described herein. In some embodiments using the state space scheme (e.g., in order to anticipate the compressibility of the heated fluid, such as steam), a time-dependent history of one or more inputs and/or outputs may be taken into account.

As illustrated, a desired flow rate 504 (e.g., of air or fuel or other fluid) is compared, by summing (or other) function 502 to an actual flow rate through a valve 518. The PID control of system 500 includes an integral term including an error integration function 506 and an integral gain 510; a proportional term (or gain) 522); and a derivative term including a numerical derivative 508 (e.g., a Laplace transform representation of the derivative term) and a derivative gain 512. The integral, proportional, and derivative terms are then added, through the summing (or other) function 514 to account for the total error between desired flow rate 504 and the actual flow rate through the valve 518. A transfer (or other) function 516 may then be applied to account for a feed forward term 520. As illustrated, the feed forward term 520 may be a feed forward decoupling term, which may be determined according to, for example, a well pressure (e.g., of the wellbore 102 and/or at the wellhead of the wellbore 102) and a fluid supply pressure (e.g., of air or fuel). In some embodiments, the feed forward term 520 may decouple the fluid pressure from the control of the valve 518. Based on the combination of the feed forward term 520 and the feedback control from the PID control, a revised valve position setpoint is fed to the valve 518.

A number of embodiments have been described. Nevertheless, it will be understood that various modifications may be made. Accordingly, other embodiments are within the scope of the following claims.

What is claimed is:

1. A method for controlling a downhole heated fluid generation system, comprising:

receiving an input indicative of a desired flow rate of a heated fluid comprising steam, the heated fluid generated by the downhole heated fluid generation system to inject into at least one of a wellbore or a subterranean zone;

receiving an input indicative of a desired quality of the heated fluid;

determining a virtual flow rate of the heated fluid based, at least in part, on the input indicative of the desired flow rate;

controlling a plurality of subsystems of the downhole heated fluid generation system with the virtual flow rate of the heated fluid;

combusting an airflow and a fuel in a downhole combustor of the downhole heated fluid generation system to generate heat; and generating the steam by applying the generated heat to a treatment fluid supplied to the downhole combustor.

2. The method of claim 1, wherein determining a virtual flow rate of the heated fluid based, at least in part, on the input indicative of the desired flow rate comprises determining the virtual flow rate of the heated fluid independent of the input indicative of the desired quality of the heated fluid.

3. The method of claim 1, wherein controlling a plurality of subsystems of the downhole heated fluid generation system with the virtual flow rate of the heated fluid comprises:

determining an expected airflow rate through an air subsystem of the downhole heated fluid generation system based, at least in part, on the virtual flow rate of the heated fluid;

determining an actual airflow rate through the air subsystem; and adjusting the virtual flow rate of the heated fluid based, at least in part, on the actual airflow rate and the expected airflow rate.

4. The method of claim 3, wherein adjusting the virtual flow rate of the heated fluid based, at least in part, on the difference between the actual airflow rate and the expected airflow rate comprises:

reducing the virtual flow rate when the actual airflow rate is less than the expected airflow rate.

5. The method of claim 3, wherein determining an expected airflow rate through an air subsystem of the downhole heated fluid generation system comprises:

determining an air-to-fuel ratio based, at least in part, on the input indicative of the desired quality of the heated fluid; and calculating the expected airflow rate based on the air-to-fuel ratio and the virtual flow rate of the heated fluid.

6. The method of claim 5, further comprising:

calculating an expected fuel flow rate based on the air-to-fuel ratio and at least one of the expected airflow rate or the virtual flow rate of the heated fluid.

7. The method of claim 1, wherein controlling a plurality of subsystems of the downhole heated fluid generation system with the virtual flow rate of the heated fluid comprises:

determining an expected treatment fluid flow rate through a treatment fluid subsystem of the downhole heated fluid generation system based, at least in part, on the virtual flow rate of the heated fluid;

determining an actual treatment fluid flow rate through the treatment fluid subsystem; and adjusting the virtual flow rate of the heated fluid based, at least in part, on the actual treatment fluid flow rate and the expected treatment fluid flow rate.

8. The method of claim 1, further comprising:

receiving a feedback from at least one of the plurality of subsystems indicative of a parameter of the subsystem; and adjusting the virtual flow rate of the heated fluid based, at least in part, on the feedback.

9. The method of claim 8, further comprising:

comparing the feedback indicative of the parameter of the subsystem to a setpoint of the parameter;

determining a difference between the feedback and the setpoint; and adjusting the virtual flow rate of the heated fluid based, at least in part, on the determined difference between the feedback and the setpoint.

10. The method of claim 9, wherein adjusting the virtual heated fluid generation rate based at least partially on the determined difference between the feedback and the setpoint comprises:

reducing the virtual heated fluid generation rate based on the determined difference between the feedback and the setpoint being below a threshold value.

11. The method of claim 1, wherein the input indicative of a desired quality of the heated fluid comprises a value indicative of steam quality between 0% and 100%.

12. The method of claim 1, wherein controlling a plurality of subsystems of the downhole heated fluid generation system with the virtual flow rate of the heated fluid comprises controlling all of the subsystems of the downhole heated fluid generation system with the virtual flow rate of the heated fluid, each of the subsystems having a corresponding rate of response, the method further comprising:

maintaining the virtual flow rate of the heated fluid to control each of the subsystems at a rate less than a slowest corresponding rate of response of the subsystems.

13. A downhole heated fluid generation system, comprising:

a plurality of subsystems, including:

an air subsystem comprising an air compressor and an air flow control valve;

a fuel subsystem comprising a fuel compressor and a fuel flow control valve; and a treatment fluid subsystem comprising a fluid pump;

a combustor fluidly coupled to at least one of the plurality of subsystems, the combustor operable to provide a heated fluid into at least one of a wellbore or a subterranean zone; and a controller operable to:

receive an input indicative of a desired flow rate of the heated fluid;

receive an input indicative of a desired quality of the heated fluid;

determine a virtual flow rate of the heated fluid based, at least in part, on the input indicative of the desired flow rate;

control the plurality of subsystems with the virtual flow rate of the heated fluid; and determine the virtual flow rate of the heated fluid independent of the input indicative of the desired quality of the heated fluid.

14. The system of claim 13, wherein the controller is further operable to:

determine an expected airflow rate through the air subsystem based, at least in part, on the virtual flow rate of the heated fluid;

determine an actual airflow rate through the air subsystem; and adjust the virtual flow rate of the heated fluid based, at least in part, on the actual airflow rate and the expected airflow rate.

15. The system of claim 14, wherein the controller is further operable to:

reduce the virtual flow rate when the actual airflow rate is less than the expected airflow rate.

16. The system of claim 14, wherein the controller is further operable to:

determine an air-to-fuel ratio based, at least in part, on the input indicative of the desired quality of the heated fluid; and calculate the expected airflow rate based on the air-to-fuel ratio and the virtual flow rate of the heated fluid.

17. The system of claim 16, wherein the controller is further operable to:

calculate an expected fuel flow rate through the fuel subsystem based on the air-to-fuel ratio and at least one of the expected airflow rate or the virtual flow rate of the heated fluid.

18. The system of claim 13, wherein the controller is further operable to:

determine an expected treatment fluid flow rate through the treatment fluid subsystem system based, at least in part, on the virtual flow rate of the heated fluid;

determine an actual treatment fluid flow rate through the treatment fluid subsystem; and adjust the virtual flow rate of the heated fluid based, at least in part, on the actual treatment fluid flow rate and the expected treatment fluid flow rate.

19. The system of claim 13, wherein the controller is further operable to:

receive a feedback from at least one of the plurality of subsystems indicative of a parameter of the subsystem; and adjust the virtual flow rate of the heated fluid based, at least in part, on the feedback.

20. The system of claim 19, wherein the controller is further operable to:

compare the feedback indicative of the parameter of the subsystem to a setpoint of the parameter;

determine a difference between the feedback and the setpoint; and adjust the virtual flow rate of the heated fluid based, at least in part, on the determined difference between the feedback and the setpoint.

21. The system of claim 20, wherein the controller is further operable to:

reduce the virtual heated fluid generation rate based on the determined difference between the feedback and the setpoint being below a threshold value.

22. The system of claim 13, wherein the controller is further operable to:

maintain the virtual flow rate of the heated fluid to control all of the plurality of subsystems at a rate less than a slowest corresponding rate of response of the subsystems.

* * * * *